US006612630B1

(12) United States Patent
Meinke

(10) Patent No.: US 6,612,630 B1
(45) Date of Patent: Sep. 2, 2003

(54) MOTOR VEHICLE DOOR HANDLE ASSEMBLY WITH SPLIT HOUSING

(75) Inventor: Joseph S. Meinke, Gowen, MI (US)

(73) Assignee: Adac Plastics Inc., Grand Rapids, MI (US)

( * ) Notice: Subject to any disclaimer, the term of this patent is extended or adjusted under 35 U.S.C. 154(b) by 85 days.

(21) Appl. No.: 09/687,798

(22) Filed: Oct. 13, 2000

(51) Int. Cl.[7] ..... E05B 3/00

(52) U.S. Cl. ..... 292/348; 292/336.3; 292/347; 292/DIG. 53

(58) Field of Search ..... 292/348, 347, 292/336.3, DIG. 53; 16/DIG. 7, 412, 438; 296/214

(56) References Cited

U.S. PATENT DOCUMENTS

| | | | | | |
|---|---|---|---|---|---|
| 2,404,845 | A | | 7/1946 | Joachim | |
| 3,159,415 | A | | 12/1964 | Sandor | |
| 3,507,132 | A | | 4/1970 | Schwenk | |
| 3,990,531 | A | * | 11/1976 | Register | 180/281 |
| 4,382,622 | A | * | 5/1983 | Ishikawa | 292/216 |
| 4,475,754 | A | * | 10/1984 | Arlauskas et al. | 292/336.3 |
| 4,482,179 | A | * | 11/1984 | Johnson | 292/336.3 |
| 4,883,296 | A | * | 11/1989 | Laurie | 292/336.3 |
| 5,123,687 | A | * | 6/1992 | Pfeiffer et al. | 292/336.3 |
| 5,308,130 | A | * | 5/1994 | Lee | 292/229 |
| 5,560,659 | A | * | 10/1996 | Dault | 292/336.3 |
| 5,632,516 | A | * | 5/1997 | Schwab | 292/336.3 |
| 5,669,642 | A | * | 9/1997 | Kang | 292/336.3 |
| 5,685,581 | A | | 11/1997 | Kritzler et al. | |
| 5,706,554 | A | * | 1/1998 | Ruckert et al. | 16/412 |
| 5,769,471 | A | * | 6/1998 | Suzuki et al. | 292/216 |
| 5,791,703 | A | | 8/1998 | Kritzler et al. | |
| 5,844,470 | A | * | 12/1998 | Garnault et al. | 180/287 |
| 5,855,408 | A | * | 1/1999 | Rickabus | 105/354 |
| 5,860,684 | A | * | 1/1999 | Mizuki | 292/336.3 |
| 5,868,448 | A | * | 2/1999 | Izumo | 217/60 C |
| 5,887,918 | A | | 3/1999 | Okada et al. | |
| 5,904,385 | A | * | 5/1999 | Linder | 292/336.3 |
| 5,975,597 | A | * | 11/1999 | Makiuchi et al. | 292/336.3 |
| 6,007,122 | A | * | 12/1999 | Linder et al. | 292/216 |
| 6,010,167 | A | * | 1/2000 | Tanimoto et al. | 292/336.3 |
| 6,036,243 | A | * | 3/2000 | Blom | 292/336.3 |
| 6,039,366 | A | * | 3/2000 | Lewis | 292/352 |
| 6,042,159 | A | * | 3/2000 | Spitzley et al. | 16/111.1 |
| 6,059,329 | A | * | 5/2000 | Spitzley | 16/412 |
| 6,067,869 | A | * | 5/2000 | Chilla et al. | 292/336.3 |
| 6,108,979 | A | * | 8/2000 | Saffran et al. | 292/336.3 |
| 6,158,788 | A | * | 12/2000 | Ikeda et al. | 292/216 |
| 6,234,041 | B1 | * | 5/2001 | Larabet et al. | 74/523 |
| 6,234,548 | B1 | * | 5/2001 | Mittelbach et al. | 292/336.3 |
| 6,296,285 | B1 | * | 10/2001 | Alvring et al. | 292/146 |
| 6,401,302 | B1 | * | 6/2002 | Josserand et al. | 16/444 |

* cited by examiner

*Primary Examiner*—Robert J. Sandy
*Assistant Examiner*—Matthew E. Rodgers
(74) *Attorney, Agent, or Firm*—Young & Basile P.C.

(57) ABSTRACT

A motor vehicle door handle assembly including a first housing piece adapted to be mounted at one end of a bowl shaped depression formed in the outer skin of the vehicle door, a second housing piece adapted to be mounted at the other end of the depression in the outer skin, and an elongated handle pivotally mounted at one end thereof on the first housing piece and including a latch finger on the other end thereof received in a receptacle in the second housing piece to allow access to a latch actuator to control the latching and unlatching of the door.

12 Claims, 3 Drawing Sheets

MOTOR VEHICLE DOOR HANDLE ASSEMBLY WITH SPLIT HOUSING

BACKGROUND OF THE INVENTION

This invention relates to handle assemblies and more particularly to handle assemblies for controlling the latch mechanisms on motor vehicle doors.

In a typical motor vehicle door handle assembly, a piece of the outer skin of the door is removed to provide an opening, an escutcheon or housing is positioned on the outer skin with a central bowl portion of the housing positioned in the opening in the outer skin, and a handle is pivotally mounted on the housing member to control the opening and closing movement of the door. This arrangement is wasteful in the sense that it requires that a piece of the outer skin of the door be removed to allow the bowl of the housing to fit into the outer skin; a relatively large amount of material is required to form the housing because of the complex and large configuration of the housing; and the large housing largely dictates the aesthetics of the handle assembly.

SUMMARY OF THE INVENTION

This invention is directed to an improved door handle assembly.

More specifically this invention is directed to a door handle assembly that does not require the formation of a large hole in the outer skin of the door to accommodate the housing of the handle assembly.

Yet more specifically this invention is directed to a handle assembly requiring minimal materials to thereby reduce the cost of the overall assembly.

Yet more specifically this invention is directed to a handle assembly presenting a cleaner, uncluttered, more attractive appearance.

The door handle assembly of the invention is of the type comprising a housing adapted to be mounted on the outer skin of the vehicle door and a handle adapted to be mounted on the housing for movement between a closed, latched position and an open, unlatched position.

According to the invention, the handle has an elongated configuration and includes mounting structure proximate each of first and second ends thereof, and the housing is formed in two separate first and second housing pieces adapted to be separately mounted on the outer skin of the door at spaced locations on the door and each including mounting structure for coaction with the mounting structure on a respective handle end to mount the handle on the door skin. This arrangement eliminates the need for the formation of a large hole in the outer skin of the door and allows a depression to be formed in the outer skin of the door to replace the central bowl shaped portion of the prior art housing members.

According to a further feature of the invention, the mounting structure on the first housing piece coacts with the mounting structure on the first handle end to pivotally mount the handle on the door at the first handle end and the mounting structure on the second handle piece defines a seat to receive the second end of the handle as the handle moves pivotally to its closed position. This specific arrangement allows the split housing structure to accommodate the typical pivotal movement of the handle.

According to a further feature of the invention, the handle includes a latch finger projecting from the second end thereof and the second housing piece further defines a receptacle to receive the latch finger in the closed position of the handle. This arrangement facilitates the operation of the door latch mechanism by the pivoting handle.

According to a further feature of the invention, the handle assembly further includes a latch actuator pivotally mounted on the receptacle and the latch finger engages the latch actuator to control the latching and unlatching of the door. This specific arrangement facilitates the latching and unlatching of the door in response to the pivotal movement of the handle.

According to a further feature of the invention, a vehicle door handle assembly is provided including a door having an outer skin having a bowl shaped depression formed therein; a first housing piece mounted on the outer skin of the door at a first end of the depression and including handle mounting structure; a second separate housing piece mounted on the outer skin of the door at a second end of the depression and including handle mounting structure; and a handle having an elongated configuration and including mounting structure proximate each of first and second ends thereof coacting with the mounting structure on the first and second housing pieces, respectively, to mount the handle on the door skin, in a position bridging the depression, for movement between a closed, latched position and an open, unlatched position. This door assembly construction allows the utilization of the outer skin of the door to form the depression behind the door handle to accommodate opening and closing movement of the handle rather than requiring that the housing include a bulky central bowl shaped portion fitted in an opening in the door skin to provide the depression behind the handle.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
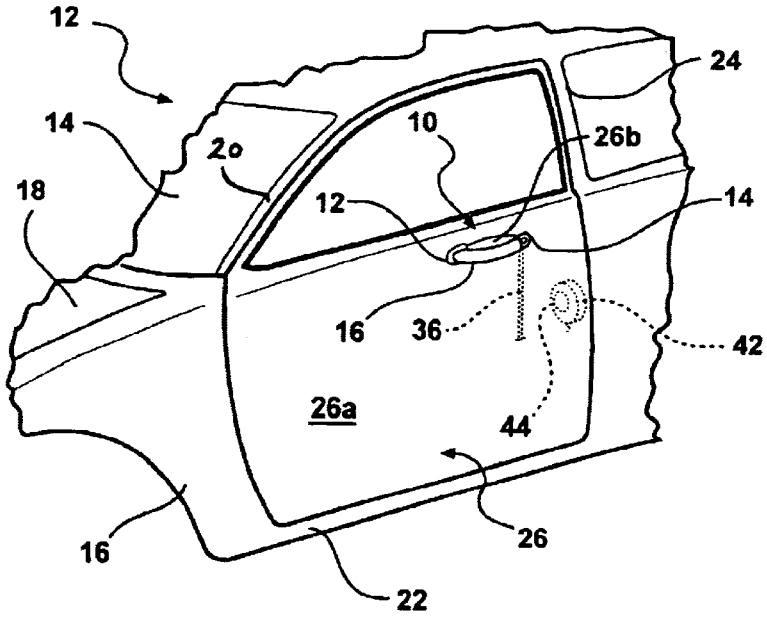
FIG. 1 is a fragmentary perspective view of a motor vehicle including a door handle assembly including a door embodying the door handle assembly of the invention.

The invention door handle assembly 10 is seen in FIG. 1 in association with a fragmentarily shown motor vehicle 12 including a windshield 14, a front quarter panel 16, a hood 18, an A-pillar 20, a sill 22, and B-pillar 24, and a door 26 positioned in the door opening defined by the A-pillar 20, front quarter panel 16, sill 22, and B-pillar 24.

Figure 7:
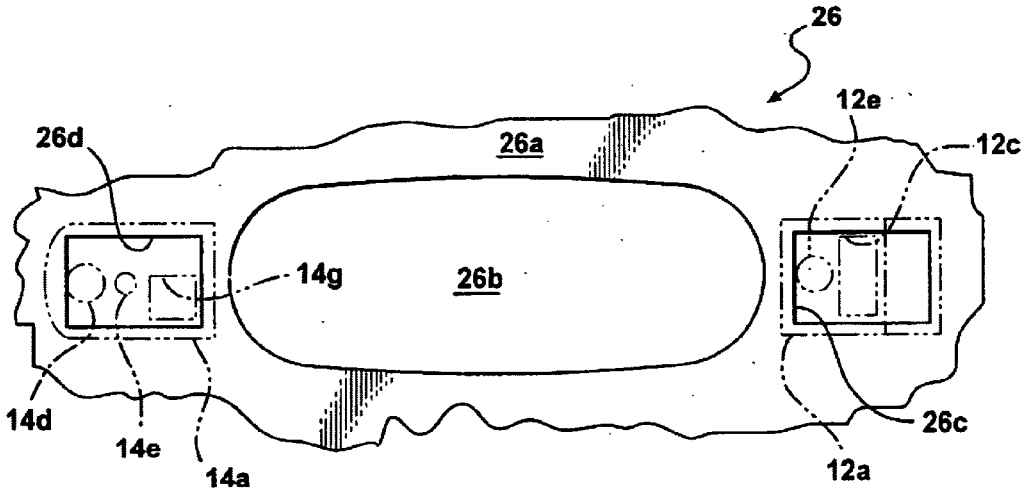
FIG. 7 is a fragmentary view of the outer skin of the door proximate the invention door handle assembly.

Door 26 includes an outer skin 26*a*which is formed (FIG. 7) with an elongated depression 26*b*, a front mounting aperture 26*c* proximate a front end of the depression, and a rear mounting aperture 26*d* proximate a rear end of the depression.

Figure 2:
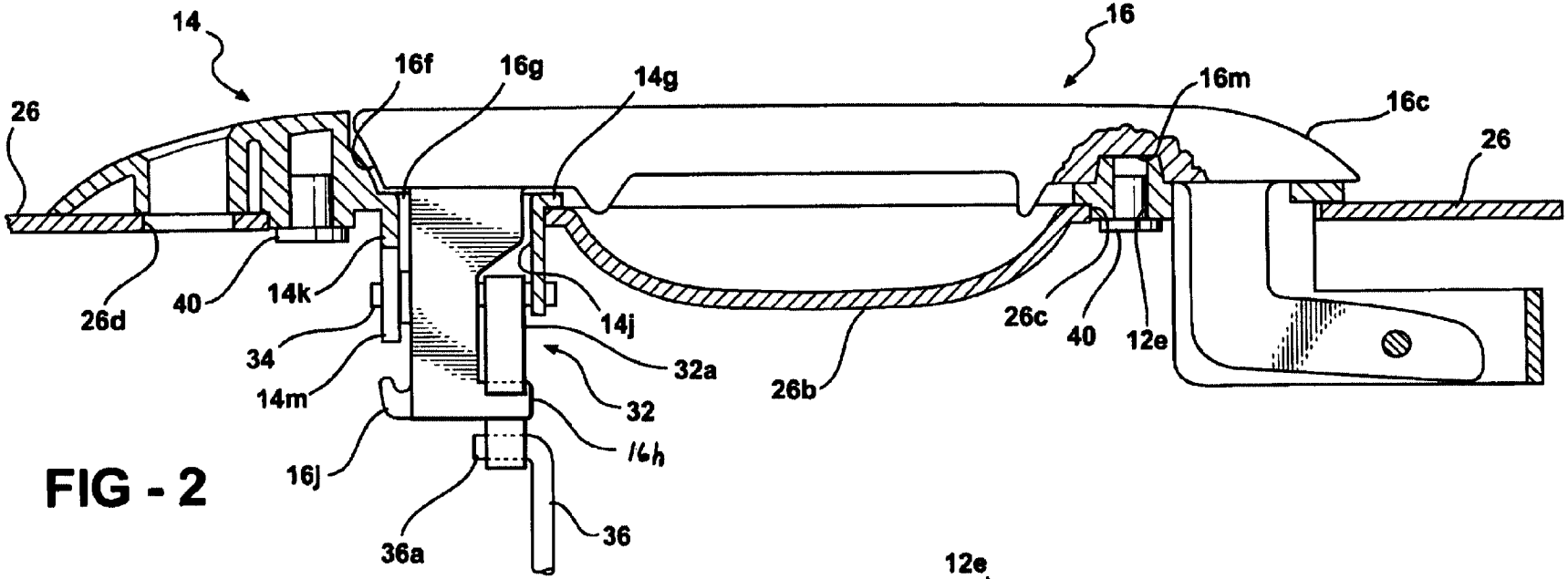
FIG. 2 is a cross-sectional view of the invention door handle assembly.

Door handle assembly 10 (FIG. 2) includes a front housing piece 12, a rear housing piece 14, and a handle 16.

Figure 5:
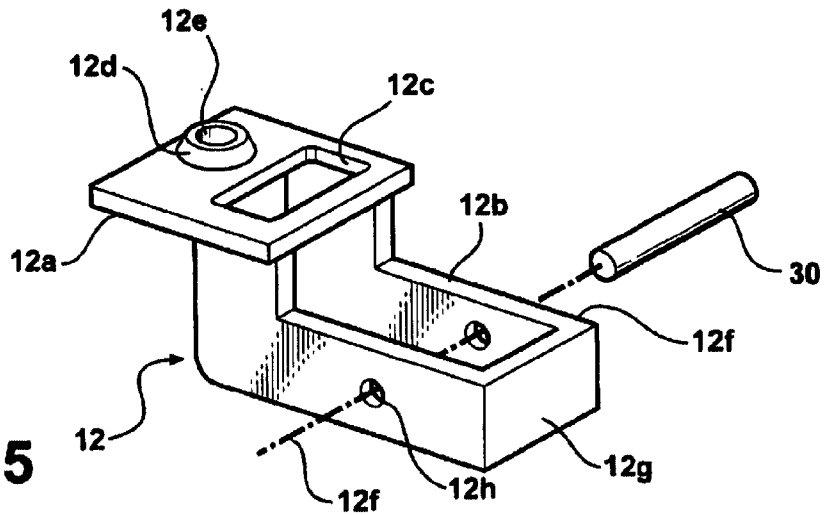
FIG. 5 is a perspective view of a second housing piece forming a part of the door handle assembly.
Figure 6:
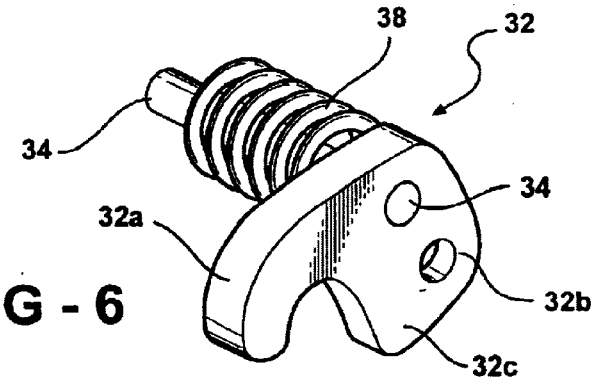
FIG. 6 is a perspective view of a latch actuator assembly forming a part of the invention door handle assembly.

Front housing piece 12 (FIGS. 2 and 5) includes an upper flange portion 12*a* and a lower yoke portion 12*b*. Upper flange portion 12*a* has a rectangular configuration and defines a rectangular opening 12*c* and a conical boss 12*d* upstanding from the flange and defining a central bore 12*e*. Yoke 12*b* is constituted by spaced parallel side walls 12*f* and an end wall 12*g*. A pair of aligned apertures 12*h* are provided in side walls 12*f*.

Figure 4:
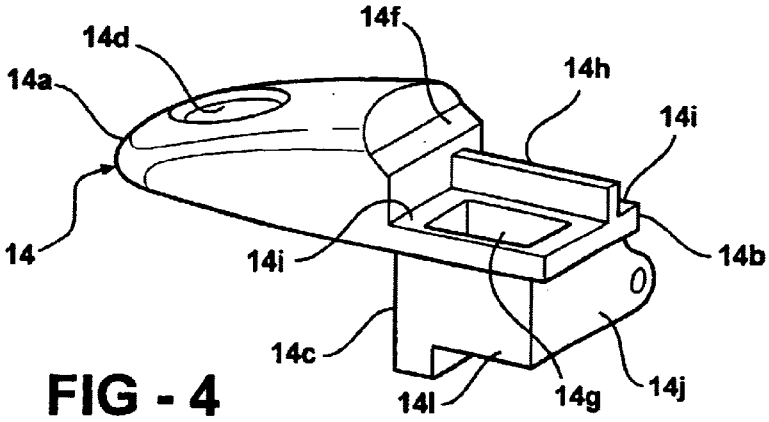
FIG. 4 is a perspective view of a first housing piece forming a part of the door handle assembly.

Rear housing piece 14 (FIGS. 2 and 4) defines a key cylinder portion 14*a*, a flange portion 14*b*, and a receptacle portion 14*c*. Key cylinder portion 14*a* defines a bore 14*d* for receipt of a key cylinder lock assembly in known manner and further defines a downwardly opening bore 14*e*. The front face of key cylinder portion 14*a* defines a stepped seating surface 14*f*.

Flange portion 14*b* has a generally rectangular configuration and includes a central opening 14*g* and a guide fin 14*h*. Flange portion 14*b* further defines an annular seating surface 14*i* in surrounding relation to aperture 14*g* and fin 14*h*.

Receptacle 14*c* has a hollow rectangular configuration and extends downwardly from flange 14*b* with the central rectangular bore 14*j* of the receptacle portion coinciding with aperture 14*g* in the flange portion 14*b*. Receptacle 14*c* is constituted by a front wall 14*j*, a rear wall 14*k*, and a side wall 14*l*.

Figure 3:
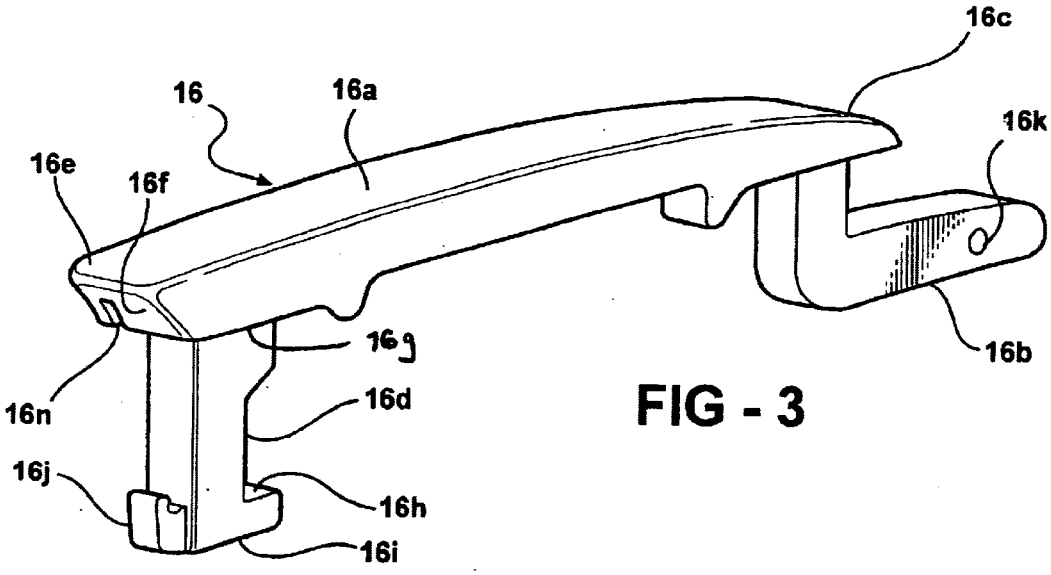
FIG. 3 is a perspective view of a handle forming a part of the door handle assembly.
Figure 9:
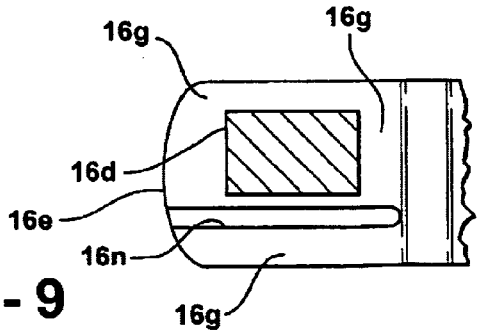
FIG. 9 is a detail view of an end of the handle.

Handle 16 (FIGS. 2 and 3) has an elongated configuration and includes an elongated central main body portion 16*a*, an angled pivot arm 16*b* proximate the front end 16*c* of the handle, and a latch finger 16*d* proximate the rear end 16*e* of the handle. The rear end 16*e* of the handle has a stepped configuration defining a stepped seating surface 16*f* generally corresponding to the stepped seating surface 14*f* on housing piece 14, and an annular seating surface 16*g* (FIG. 9) generally corresponding to annular seating surface 14*i* is defined on the rear end of the handle in surrounding relation to latch finger 16*d*. Latch finger 16*d* has a cross-sectional configuration sized to pass loosely through aperture 14*g* in the flange portion 14*b* of housing piece 14 and includes a hook portion 16*h* projecting from the front face of the free lower end 16*i* of the latch finger and a guide portion 16*j* projecting from the rear face of the free lower end of the latch finger.

In the mounted disposition of the door handle assembly on the door (FIGS. 2 and 7), front housing piece 12 is positioned proximate door skin opening 26*c* with flange portion 12*a* positioned against the outer face of the door skin in surrounding relation to opening 26*c* and with the yoke portion 12*b* extending downwardly through the opening to position the yoke in underlying relation to the door skin within the interior of the door; rear housing piece 14 is positioned proximate door skin opening 26*d* with flange 14*b* and the peripheral edge portion of key cylinder portion 14*a* positioned in surrounding relation to door skin opening 26*d* and with receptacle portion 14*c* extending downwardly through opening 26*d* to position the receptacle beneath the skin within the interior of the door; the front end 16*c* of handle 16 is pivotally mounted on housing piece 12 with pivot arm 16*b* passing downwardly through aperture 12*c* in the housing piece and through door skin opening 26*c* to position the pivot arm between the side walls 12*f* of the yoke of the housing piece with the pivot arm pivotally mounted on the housing piece via a pivot pin 30 passing through aligned apertures 12*h* and through an aperture 16*k* in pivot arm 16*b*; and the rear end 16*e* of the handle is positioned proximate housing piece 14 with latch finger 16*d* extending downwardly through aperture 14*g* to position the lower end 16*i* of the latch finger beneath the lower end of the receptacle within the interior of the door where the hook portion 16*h* engages one arm 32*a* of a bell crank latch actuator 32 positioned in the receptacle 14*c* via a pivot pin 34 mounted in receptacle walls 14*j* and 14*k*. A latch link 36 is pivotally received at its upper end 36*a* in an aperture 32*b* in the other leg 32*c* of the bell crank actuator and a coil spring 38 is positioned around pin 34 with its opposite ends anchored in known manner to the housing piece 14 and to the bell crank actuator so as to provide a resilient resistance to pivotal movement of the actuator and thereby to opening movement of the handle.

Figure 8:
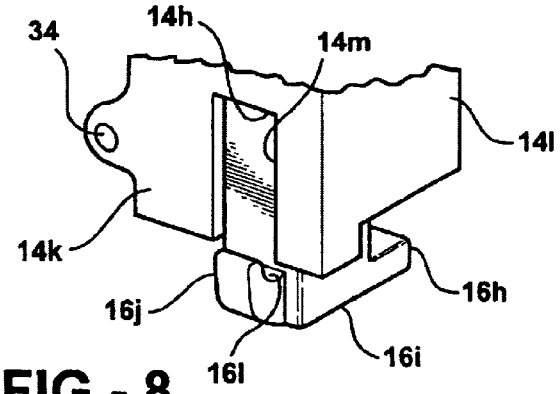
FIG. 8 is a detail perspective view of a portion of the door handle assembly.

Guide finger 16*j* guides in a slot 14*m* (FIG. 8) in the rear wall 14*k* of the receptacle 14*c* to guide the opening and closing movement of the handle and to define the limit of the opening movement of the handle by virtue of the engagement of the surface 161 of the guide finger with the upper edge 14*n* of slot 14*m*.

In the closed position of the handle, conical boss 12*d* guides into a conical hollow depression 16*m* in the lower face of the handle proximate the front end 16*c* of the handle to facilitate proper alignment of the handle with the front housing piece 12, a slot 16*n* on the lower face of the handle proximate the front end 16*e* of the handle is fitted over fin 14*h* to facilitate proper alignment of the handle with rear housing piece 14, handle stepped seating surface 16*f* seats against rear housing step seating surface 14*f*, and handle annular seating surface 16*g* seats against rear housing annular seating surface 14*i*.

The front and rear housing pieces are suitably secured to the skin or other portion of the door. For example, an insert nut 40 may be positioned in the bore 12*e* of boss 12*d* of housing member 12 for receipt of a suitable fastener to secure front housing piece 12 to the skin or other portion of the door and a further insert nut 40 may be received in the bore 14*e* of housing piece 14 for receipt of a suitable fastener to secure the front piece to the skin or other portion of the door. It will be understood that pivotal movement of the door about the axis of pin 30 has the affect of pivoting latch actuator 32 about the axis of pin 34 to move the latch link 36 in a direction to unlatch a latch mechanism 42 of known form provided on the rear face of the door for coaction with a striker 44 on the B-pillar. It will be seen that the depression 26*b* provided in the outer skin of the door provides a recess behind the main body portion of the handle to facilitate the positioning of fingers behind the handle to move the handle to an open position.

The invention door handle assembly will be seen to provide many important advantages. Specifically, the use of separate front and rear housing pieces eliminates the need to remove a portion of the outer skin of the door to accommodate the central bowl of the usual housing member thereby affecting both labor and material savings; the amount of material required to form the housing is significantly reduced since the bulky central bowl portion has been totally eliminated; and the elimination of the bulky central portion of the housing provides styling freedom and specifically allows the design of a cleaner, more attractive door handle assembly.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A motor vehicle door assembly comprising a housing adapted to be mounted on an outer skin of the vehicle door, a handle mounted on the housing for movement between a closed, latched position and an open, unlatched position, and a latch actuator controlled by handle movement and operative to latch and unlatch the door latch, characterized in that:

the outer skin includes inner and outer surfaces and separate spaced first and second mounting apertures;

the handle is positioned proximate the outer surface of the skin, has an elongated configuration and includes mounting structure proximate each of first and second ends thereof;

the housing is formed in two separate unconnected first and second housing pieces separately secured to the outer skin proximate the first and second apertures respectively and each including a flange structure positioned against the outer surface of the skin in surrounding relation to a respective aperture and mounting structure extending through the respective aperture into the interior of the door for coaction with the mounting structure on a respective handle end to mount the handle on the door skin; and the latch actuator is mounted on one of the housing pieces for coaction with a respective handle end.

2. A motor vehicle door assembly according to claim 1 wherein:

the mounting structure on the first housing piece coacts with the mounting structure on the first handle end to pivotally mount the handle on the door at the first handle end; and the mounting structure on the second housing piece pivotally mounts the latch actuator and the flange structure of the second housing piece defines an annular seating surface for seating against an annular seating surface on the second end of the handle as the handle moves pivotally to its closed position.

3. A motor vehicle door assembly according, to claim 2 wherein:

the handle includes a latch finger projecting from the second end thereof; and the mounting structure of the second housing piece defines a receptacle to receive the latch finger in the closed position of the handle.

4. A motor vehicle door assembly according to claim 3 wherein:

the latch actuator is pivotally mounted on the receptacle; and the latch finger engages the latch actuator to control the latching and unlatching of the door.

5. A motor vehicle door assembly comprising:

an outer vehicle door skin having inner and outer surfaces and including spaced separate first and second apertures;

a first housing piece including an annular flange structure mounted on the outer surface of the outer skin proximate the first aperture and further including handle mounting structure extending through the respective aperture into the interior of the door;

a second housing piece, separate from and unconnected to the first housing piece, mounted on the outer skin proximate the second aperture and including handle mounting structure;

a handle having an elongated configuration and including mounting structure proximate each of the first and second ends thereof coacting with the mounting structure on the first and second housing pieces, respectively, to mount the handle on the door skin for movement between a closed, latched position and an open, unlatched position; and a latch actuator mounted on one of the housing pieces and operative in response to handle movement to latch and unlatch a vehicle door latch.

6. A motor vehicle door assembly according to claim 5 wherein:

the mounting structure on the first housing piece coacts with the mounting structure on the first handle end to pivotally mount the handle on the door at the first handle end;

the mounting structure on the second handle piece pivotally mounts the latch actuator; and the second handle piece further includes an annular flange structure mounted on the outer surface of the outer skin proximate the second aperture and defining a seat to receive the second end of the handle as the handle moves pivotally to its closed position.

7. A motor vehicle door assembly according to claim 6 wherein:

the handle includes a latch finger projecting from the second end thereof; and the handle mounting structure of the second housing piece defines a receptacle to receive the latch finger in the closed position of the handle.

8. A motor vehicle door assembly according to claim 7 wherein:

the latch actuator is pivotally mounted on the receptacle; and the latch finger engages the latch actuator to control the latching and unlatching of the door.

9. A motor vehicle door assembly comprising:

a door having an outer skin having inner and outer surfaces having a bowl shaped depression formed therein, and including a first mounting aperture proximate a first end of the depression and a second mounting aperture proximate a second end of the depression;

a first housing piece having an annular struture positioned against the outer surface of the outer skin of the door in surrounding relation to the first mounting aperture and handle mounting struture extending through the first mounting aperture into the interior of the door;

a second separate housing piece unconnected to the first housing piece mounted on the outer skin of the proximate the second mounting aperture and including handle mounting struture; and a handle having an elongated configuration and including mounting structure proximate each of first and seconds ends thereof coacting with the mounting structure on the first and second housing pieces, respectively, to mount the handle on the door skin, in a position bridging the depression, for movement between a closed, latch position and an open, unlatch position.

10. A motor vehicle door assembly according to claim 9 wherein:

the mounting structure on the first housing piece coacts with the mounting structure on the first handle end to pivotally mount the handle on the door at the first handle end; and the mounting structure on the second handle piece defines a seat to receive the second end of the handle as the handle moves pivotally to its closed position.

11. A motor vehicle door assembly according to claim 10 wherein: the handle includes a latch finger projecting from the second end thereof; and the second housing piece further defines a receptacle to receive the latch finger in the closed position of the handle.

12. A motor vehicle door assembly according to claim 11 wherein:

the door assembly further includes a latch actuator pivotally mounted on the receptacle; and the latch finger engages the latch actuator to control the latching and unlatching of the door.

* * * * *